US005165769A

United States Patent [19]

Wolfe

[11] Patent Number: 5,165,769

[45] Date of Patent: Nov. 24, 1992

[54] DUAL ACCESSORY WARDROBE

[76] Inventor: Deborah Wolfe, 5082 Dee Rd., Memphis, Tenn. 38111

[21] Appl. No.: 790,590

[22] Filed: Nov. 8, 1991

[51] Int. Cl.[5] ..... A47B 88/00

[52] U.S. Cl. ..... 312/227; 362/129; 362/133; 362/155; 312/225

[58] Field of Search ..... 312/128, 129, 133, 155, 312/225, 226, 227, 324, 329; 211/1.3

[56] References Cited

U.S. PATENT DOCUMENTS

| | | | |
|---|---|---|---|
| 1,006,481 | 10/1911 | Johnson et al. | 312/324 |
| 1,457,347 | 6/1923 | Collins | 362/133 |
| 2,215,881 | 9/1940 | Levensten | 312/311 |
| 2,575,530 | 11/1951 | Reid | 362/129 X |
| 3,527,352 | 9/1970 | DeLapa | 211/1.3 |
| 3,665,867 | 5/1972 | Carlson et al. | 108/25 |
| 4,084,867 | 4/1978 | Putt et al. | 312/324 X |

*Primary Examiner*—Joseph Falk
*Attorney, Agent, or Firm*—Matthew F. Jodziewicz

[57] ABSTRACT

A wardrobe casement includes a generally rectangular hollow wooden casing having on a front side an opening into the interior thereof. A stack of drawers are mounted in the casing interior. A shelf is mounted above the stack of drawers and has two recessed, generally convex bowls therein adapted for receiving various articles of personal wardrobe therein. First and a second compartments, on opposite sides of the stack of drawers, have therein an extensible, horizontally extending rod adapted to receive hanging wardrobe articles as belts and ties thereon. A generally rectangular first mirror is mounted above the shelf in the casing interior. A door is hingedly mounted on the casing. A second mirror is mounted on the outer surface of the door and covers substantially all of the outer surface of the door.

10 Claims, 1 Drawing Sheet

DUAL ACCESSORY WARDROBE

NOTICE REGARDING COPYRIGHTED MATERIAL

A portion of the disclosure of this patent document contains materials which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

1. Field of the Invention

This invention relates in general to an article of furniture, and, more particularly, to that class known as wardrobes.

2. Description of the Related Art

Wardrobes must act as repositories for a large number of small and large wardrobe articles such as shirts, belts and jewelry. The problem is then to store these variously sized items in a compact, yet readily accessible manner for presentation and use that does not wrinkle or mess the items for wear.

OBJECTS AND SUMMARY OF THE INVENTION

Accordingly, it is an object of the present invention to provide a dual accessory wardrobe that stores all of the variously sized articles forming a personal wardrobe in a manner that maintains these items readily available to the wearer, yet stored in a neat and compact manner.

The novel features of construction and operation of the invention will be more clearly apparent during the course of the following description, reference being had to the accompanying drawings wherein has been illustrated a preferred form of the device of the invention and wherein like characters of reference designate like parts throughout the drawings.

DESCRIPTION OF THE PREFERRED EMBODIMENT

Figure 1:
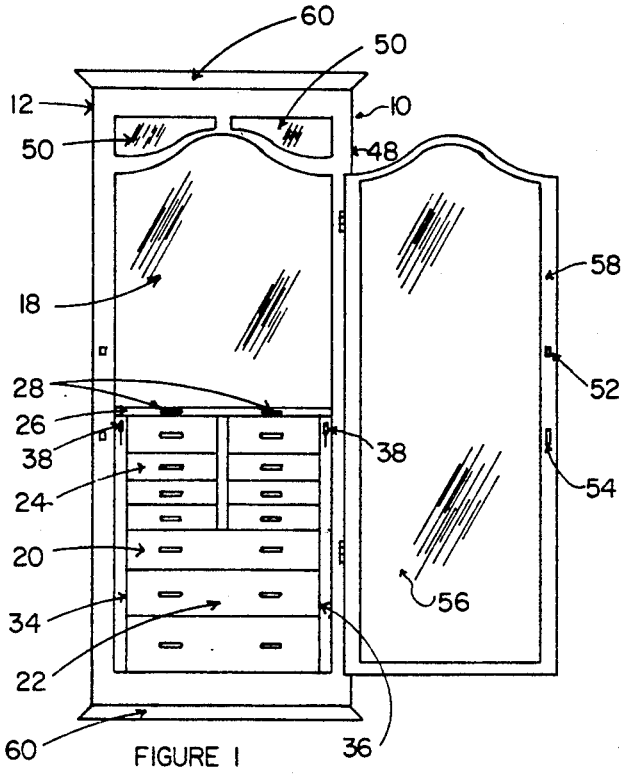
FIG. 1 is a elevation of an article of furniture constructed in accordance with the present invention showing the door swingingly mounted thereon and opened.
Figures 2, 3:
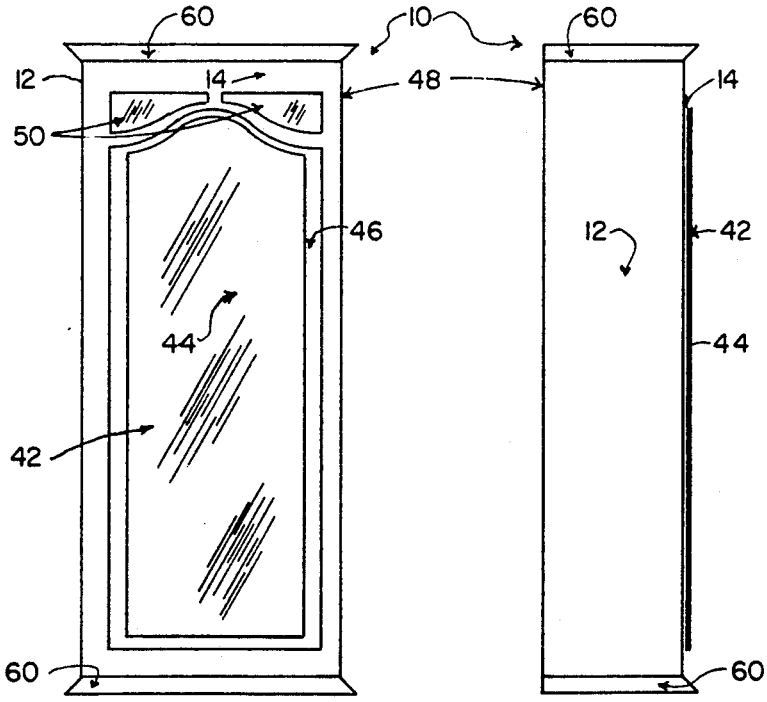
FIG. 2 is a view similar to FIG. 1 wherein the door is shown closed.
FIG. 3 is a side view of the article of furniture shown in FIG. 1.

Referring to the figures in detail, the article of furniture, which in this instance is in the form of a dual accessory wardrobe 10, and comprises a generally rectangular hollow wooden casing 12, having on a front side 14 an opening 16 into the interior 18 thereof.

A stack of drawers 20 is mounted in the casing interior 18 and is accessible through the opening 16 in the casing 12. It is preferred that the stack of drawers 20 has a first lower portion 22 with a single column of drawers, and a second upper portion 24 having two parallel columns of drawers. This configuration provides for the most flexibility in storing various items of varying sizes. It is preferred that the smaller of the two types of drawers be configured for jewelry storage by having internal sectioning of the drawers into individual compartments adapted to separate small items of jewelry for easy location and storage.

A shelf 26 is mounted above the stack of drawers 20 in the casing interior 18, and has two recessed, generally convex bowls 28 therein adapted for receiving various articles of personal wardrobe such as jewelry, earrings, rings and the like.

A first and a second compartment 30, 32, respectively, in the casing interior 18, are situated on opposite sides 34, 36, respectively of the stack of drawers 20. Each compartment has therein an extensible, horizontally extending rod 38 connected to the casing interior 18 that is adapted to receive hanging wardrobe articles as belts and ties thereon.

A generally rectangular mirror 40 is mounted above the shelf 26 in the casing interior 18 so as to permit a user to view their own image as they dress in front of the wardrobe.

A door 42 is hingedly mounted on the casing 12 and forms a closure for the opening 16 in the casing 12. The door 42 may be either straight or traversely curved outwardly from the casing interior 18 to cover the interior portion of the wardrobe.

A mirror 44 is mounted on the outer surface 46 of the door 42 and covers substantially all of the outer surface of the door. This full length mirror provides the wardrobe user a complete view of themselves as they dress.

A light (not shown) is preferably recessed mounted in the top portion 48 of the casing interior 18 above the mirror 40 in the casing interior 18, so that it provides illumination to the mirror 40 and the casing interior 18.

It is preferred that the light be automatically controlled to turn on whenever the door 42 is opened and to turn off whenever the door 42 is closed. Another embodiment within the scope of the invention is to have the light manually controlled so that it may act as a night light by leaving it on and closing the door permitting light to be visible through translucent or opaque portions 50 in the casing 12.

It is preferred that first and second locks 52, 54 respectively, are mounted on the door 42 to releasably retain the door in a closed position. In this preferred combination of two locks, the first lock 52 is operable by pressure alone as a push latch, and the second lock 54 is operable by a key to provide for greater security for contents stored in the wardrobe if necessary.

A mirror 56 is mounted on the interior portion 58 of the door 42 so that when the door 42 is partially closed, light may be reflected between the two mirrors 40 and 56 for an observer positioned therebetween.

Finally, any filigree work or ornament 60 may be added to the casing exterior or interior for aesthetic purposes and remain within the scope of the present invention.

The invention described above is, of course, susceptible to many variations, modifications and changes, all of which are within the skill of the art. It should be understood that all such variations, modifications and changes are within the spirit and scope of the invention and of the appended claims. Similarly, it will be understood that Applicant intends to cover and claim all changes, modifications and variations of the example of the preferred embodiment of the invention herein disclosed for the purpose of illustration which do not constitute departures from the spirit and scope of the present invention.

What is claimed is:

1. A wardrobe casement comprising:

a generally rectangular hollow wooden casing having on a front side an opening into the interior thereof;

a stack of drawers mounted in said casing interior and accessible through said opening in said casing;

a shelf mounted above said stack of drawers in said casing interior and having two recessed, generally convex bowls therein adapted for receiving various articles of personal wardrobe therein;

a first and a second compartment in said casing interior on opposite sides of said stack of drawers, each compartment having therein an extensible, horizontally extending rod connected to said casing interior and adapted to receive hanging wardrobe articles as belts and ties thereon;

a generally rectangular first mirror mounted above said shelf in said casing interior;

a door hingedly mounted on said casing and forming a closure for said opening in said casing; and, a second mirror mounted on the outer surface of said door and covering substantially all of the outer surface of said door.

2. A wardrobe casement as in claim 1 further comprising:

light means mounted in said casing interior above said first mirror in said casing interior, said light means being disposed in said casing interior to illuminate said first mirror and said casing interior.

3. A wardrobe casement as in claim 2 wherein said light means further comprises means for automatically controlling said light means to turn said light on whenever said door is opened and to turn said light off whenever said door is closed.

4. A wardrobe casement as in claim 1 wherein said door is traversely curved outwardly from said casing interior.

5. A wardrobe casement as in claim 1 further comprising:

first locking means mounted on said door and operable by pressure alone to releasably retain said door in a closed position.

6. A wardrobe casement as in claim 5 further comprising:

second locking means mounted on said door and operable by a key to releasably retain said door in a closed position.

7. A wardrobe casement as in claim 1 wherein said stack of drawers comprises a first lower portion having a single column of drawers, and a second upper portion having two parallel columns of drawers.

8. A wardrobe casement as in claim 1 further comprising a third mirror mounted on the interior of said door so that when said door is partially closed, light may be reflected between the two mirrors for an observer positioned therebetween.

9. A wardrobe casement as in claim 1 further comprising at least one portion of the casing being opaque to light and situated to permit light from said light means to be visible therethrough when said door is closed.

10. A wardrobe casement comprising:

a generally rectangular hollow wooden casing having on a front side an opening into the interior thereof;

a stack of drawers mounted in said casing interior and accessible through said opening in said casing, said stack of drawers having a first lower portion with a single column of drawers, and a second upper portion having two parallel columns of drawers;

a shelf mounted above said stack of drawers in said casing interior and having two recessed, generally convex bowls therein adapted for receiving various articles of personal wardrobe;

a first and a second compartment in said casing interior on opposite sides of said stack of drawers, each compartment having therein an extensible, horizontally extending rod connected to said casing interior and adapted to receive hanging wardrobe articles as belts and ties thereon;

a generally rectangular first mirror mounted above said shelf in said casing interior;

a door hingedly mounted on said casing and forming a closure for said opening in said casing, said door being traversely curved outwardly from said casing interior;

a second mirror mounted on the outer surface of said door and covering substantially all of the outer surface of said door; and, light means mounted in said casing interior above said first mirror in said casing interior, said light means being disposed in said casing interior to illuminate said first mirror and said casing interior;

first and second locking means mounted on said door, said first locking means operable by pressure alone, and said second locking means operable by a key, each to releasably retain said door in a closed position; and, means for automatically controlling said light means to turn said light on whenever said door is opened and to turn said light off whenever said door is closed; and, a third mirror mounted on the interior of said door so that when said door is partially closed, light may be reflected between the two mirrors for an observer positioned therebetween, at least one portion of the casing being opaque to light and situated to permit light from said light means to be visible therethrough when said door is closed.

* * * * *